US006644926B1

(12) United States Patent
Vandyke

(10) Patent No.: US 6,644,926 B1
(45) Date of Patent: Nov. 11, 2003

(54) VANE STRUCTURE FOR A PROPELLER

(76) Inventor: Ralph L. Vandyke, 25740 Cypress Head Pl., Wesley Chapel, FL (US) 33544

( * ) Notice: Subject to any disclaimer, the term of this patent is extended or adjusted under 35 U.S.C. 154(b) by 0 days.

(21) Appl. No.: 10/152,420

(22) Filed: May 21, 2002

(51) Int. Cl.[7] ..... B63H 1/26

(52) U.S. Cl. ..... 416/228; 416/93 A; 416/235; 416/237; 440/49; 440/66; 440/89

(58) Field of Search ..... 416/93 A, 228, 416/235, 236 R, 236 A, 237, 244 B, 245 A; 440/49, 66, 89

(56) References Cited

U.S. PATENT DOCUMENTS 471,907 A * 3/1892 Stauch, Jr. ..... 440/49
1,418,991 A * 6/1922 Thompson et al. ..... 416/228
2,086,307 A * 7/1937 Stewart ..... 416/236 A
3,092,185 A * 6/1963 Alexander, Jr. ..... 416/244 B
4,801,281 A * 1/1989 Govan ..... 440/49
5,299,961 A * 4/1994 Okamoto ..... 440/89
6,352,408 B1 * 5/2002 Kilian ..... 416/235

FOREIGN PATENT DOCUMENTS

AU 115848 A * 9/1942 ..... 416/235

* cited by examiner

*Primary Examiner*—Christopher Verdier

(57) ABSTRACT

A vane structure for a propeller for engaging fluid and preventing cavitation or the rapid formation and collapse of low-pressure gas bubbles in a liquid. The vane structure for a propeller includes a plurality of spaced vanes that are mounted to and extend away from a hub. Each of the vanes has a leading edge, a trailing edge and an end. A lip is mounted on the end of each of the vanes for selectively engaging fluid and dispersing low-pressure gas bubbles positioned generally adjacent to the plurality of spaced vanes.

4 Claims, 3 Drawing Sheets

VANE STRUCTURE FOR A PROPELLER

BACKGROUND OF THE INVENTION

1. Field of the Invention

The present invention relates to propellers and more particularly pertains to a new vane structure for a propeller for engaging fluid and preventing cavitation or the rapid formation and collapse of low-pressure gas bubbles in a liquid.

2. Description of the Prior Art

The use of propellers is known in the prior art. More specifically, propellers heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,972,646; U.S. Pat. No. 4,552,511; U.S. Pat. No. 5,192,191; U.S. Pat. No. 5,209,642; U.S. Pat. No. 3,947,151; U.S. Pat. No. 3,788,267; U.S. Pat. No. 5,017,090; U.S. Pat. No. 3,406,759; U.S. Pat. No. 3,385,374; and U.S. Pat. No. Des. 419,669.

While these devices fulfill their respective, particular objectives and requirements, the aforementioned patents do not disclose a new vane structure for a propeller. The inventive device includes a plurality of spaced vanes that are mounted to and radiate away from a hub. Each of the vanes has a leading edge, a trailing edge and an end. A lip is mounted on the end of each of the vanes for selectively engaging fluid and dispersing low-pressure gas bubbles positioned generally adjacent to the plurality of spaced vanes.

Conventional propellers employ injecting a gas from a base of the vane and the hub to force the low-pressure gas bubbles away from the propeller. The same result can be accomplished by employing a lip to the vanes. The addition of the lip is more cost and engineering efficient since there is not the need to add a gas expulsion system to the propeller.

In these respects, the vane structure for a propeller according to the present invention substantially departs from the conventional concepts and designs of the prior art, and in so doing provides an apparatus primarily developed for the purpose of engaging fluid and preventing cavitation or the rapid formation and collapse of low-pressure gas bubbles in a liquid.

SUMMARY OF THE INVENTION

In view of the foregoing disadvantages inherent in the known types of propellers now present in the prior art, the present invention provides a new vane structure for a propeller construction wherein the same can be utilized for engaging fluid and preventing cavitation or the rapid formation and collapse of low-pressure gas bubbles in a liquid.

The general purpose of the present invention, which will be described subsequently in greater detail, is to provide a new vane structure for a propeller apparatus which has many of the advantages of the propellers mentioned heretofore and many novel features that result in a new vane structure for a propeller which is not anticipated, rendered obvious, suggested, or even implied by any of the prior art propellers, either alone or in any combination thereof.

There has thus been outlined, rather broadly, the more important features of the vane structure for a propeller in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is an object of the present invention to provide a new vane structure for a propeller apparatus and method which has many of the advantages of the propellers mentioned heretofore and many novel features that result in a new vane structure for a propeller which is not anticipated, rendered obvious, suggested, or even implied by any of the prior art propellers, either alone or in any combination thereof.

Still another object of the present invention is to provide a new vane structure for a propeller for engaging fluid and preventing cavitation or the rapid formation and collapse of low-pressure gas bubbles in a liquid.

Still yet another object of the present invention is to provide a new vane structure for a propeller that reduces wear on a motor attached to the present invention. When cavitation occurs the low-pressure gas bubbles prevents the propeller from engaging fluid causing an increased rotation of the propeller. The increased rotation can cause damage to the motor.

Even still another object of the present invention is to provide a new vane structure for a propeller that prevents a propeller from slipping, or a loss of power, when a propeller connected to a boat makes a turn in water. When a boat makes a turn in water, cavitation can cause the propeller to slip. The present invention engages the water and prevents the propeller from slipping.

Yet another object of the present invention is to provide a new vane structure for a propeller that can reduce the loss of power by a boat running at full speed with an upturned motor. Motors are often turned upward to force a rear of a boat upward, thereby increasing the speed of the boat. However, the increased speed can cause a propeller to come out of the water causing a loss of power. The present invention engages more of the water when submersed reducing the loss of power.

Yet still another object of the present invention is to provide a new vane structure for a propeller employed in power plants to cool a power generating system. Cavitation can cause these propellers to have an increase in rotational speed damaging the motors necessitating repairs and replacement.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
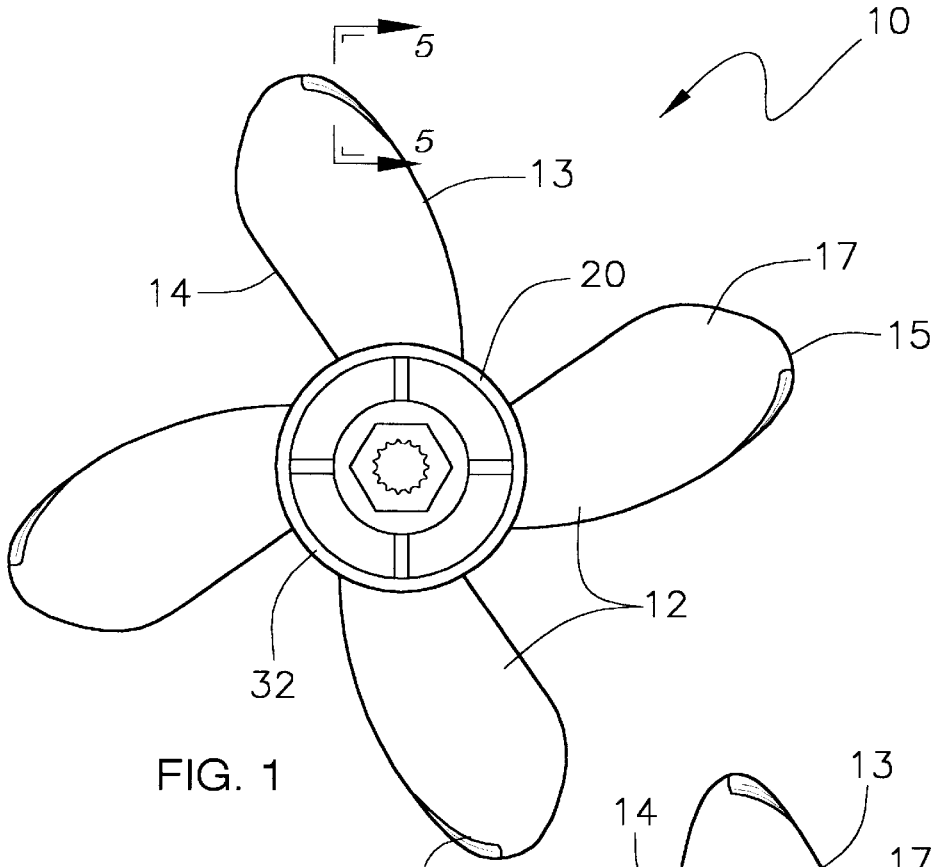
FIG. 1 is a rear elevational view of a new vane structure for a propeller according to the present invention.

With reference now to the drawings, and in particular to FIGS. 1 through 5 thereof, a new vane structure for a propeller embodying the principles and concepts of the present invention and generally designated by the reference numeral 10 will be described.

As best illustrated in FIGS. 1 through 5, the vane structure for a propeller 10 generally comprises a hub 20 and a plurality of spaced vanes 12 that are mounted to and that extend away from the hub 20. Each of the vanes 12 has a leading edge 13, a trailing edge 14 and an end 15.

Figure 2:
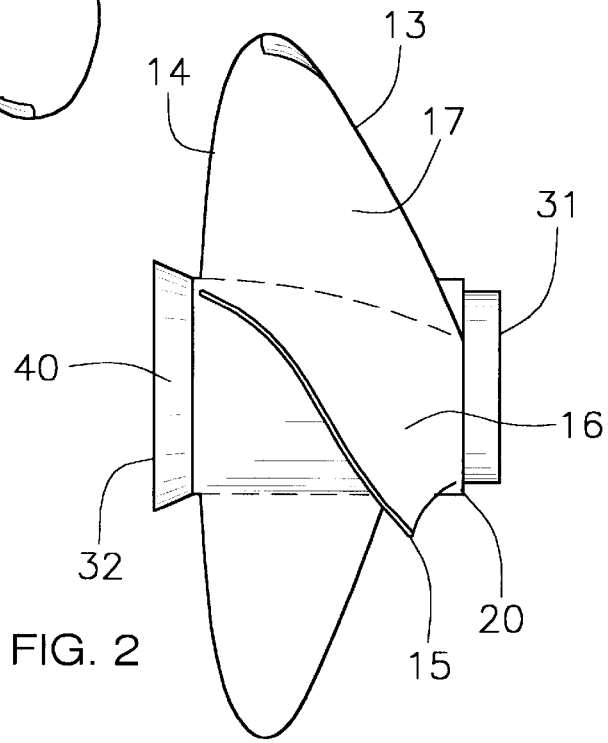
FIG. 2 is a side elevational view of the present invention.
Figure 4:
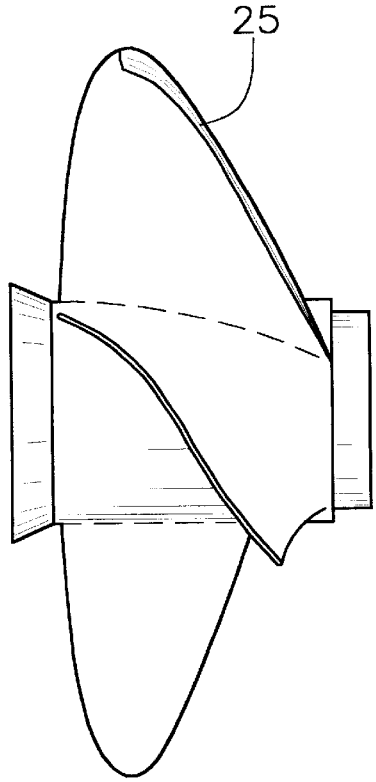
FIG. 4 is a side elevational view of another embodiment of the present invention.

Each of the vanes 12 has first 16 and second 17 opposed surfaces that begin at the leading edge 13 and terminate at the trailing edge 14. As illustrated in FIGS. 2 and 4, each of the spaced vanes 12 is generally curved for engaging a fluid such as, for example, water and propelling or moving a motor that is operationally coupled to the hub 20.

Each of the spaced vanes 12 may comprise a substantially rigid material such as, for example, steel or aluminum. However, other types of materials may also be employed.

A lip 25 is mounted on the end 15 of each of the spaced vanes 12 for selectively engaging the fluid and dispersing low-pressure gas bubbles that develop and become positioned generally adjacent to the plurality of spaced vanes 12.

Figure 5:
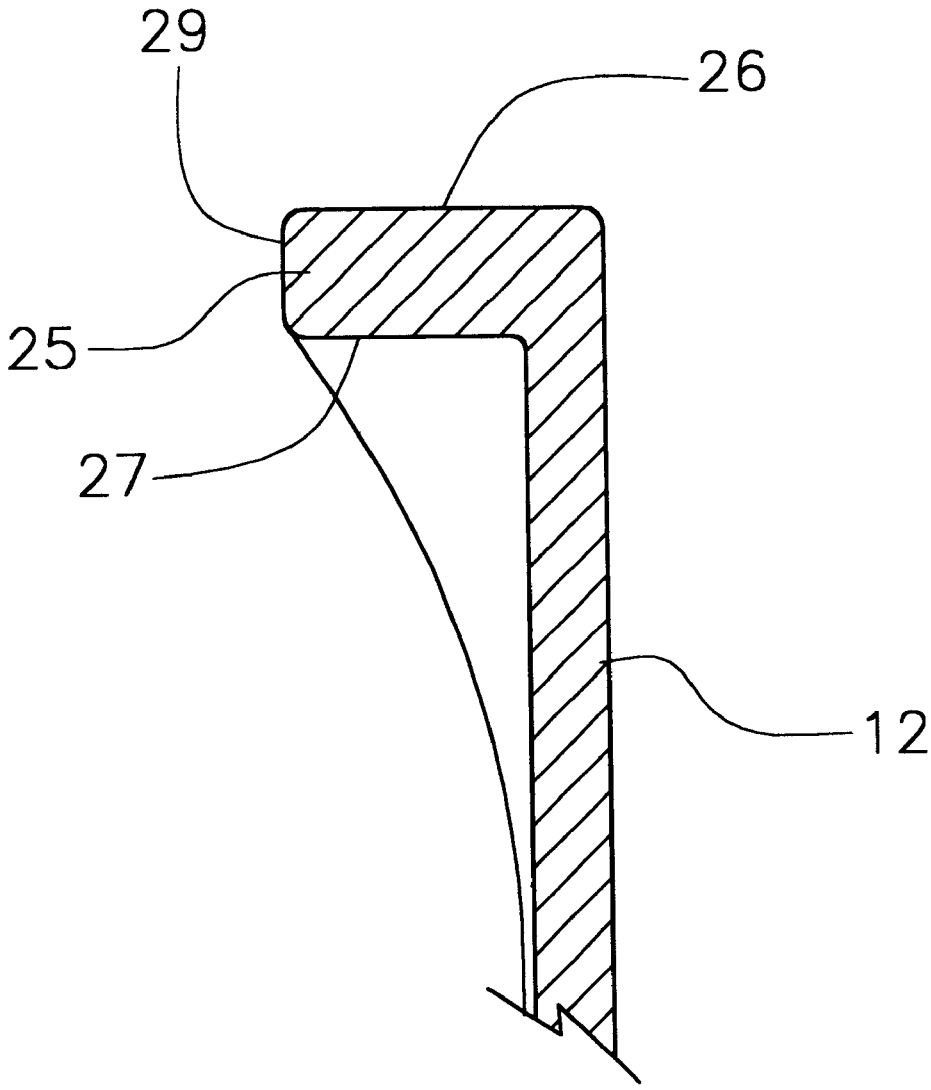
FIG. 5 is a cross sectional view of the present invention taken along line 5—5 of FIG. 1.

As illustrated in FIG. 5, the lip 25 mounted on each of the vanes 12 is orientated generally perpendicular to each of the spaced vanes 12. The lip 25 may also have a generally curve shape such that an end of the lip 25 extends toward the hub 20.

As illustrated in FIGS. 1–5, the overall width of the lip 25 may vary. The width of the lip 25 determines how much fluid will be engaged. The longer the width of the lip 25 the more fluid that will be engaged and the less cavitation that will occur.

In one embodiment of the present invention, as particularly illustrated in FIGS. 1 and 2, the lip 25 mounted on each of the vanes 12 may extend along a portion of the leading edge 13 of each of the spaced vanes 12 and may terminate at approximately one-quarter a length of the spaced vanes 12.

Figure 3:
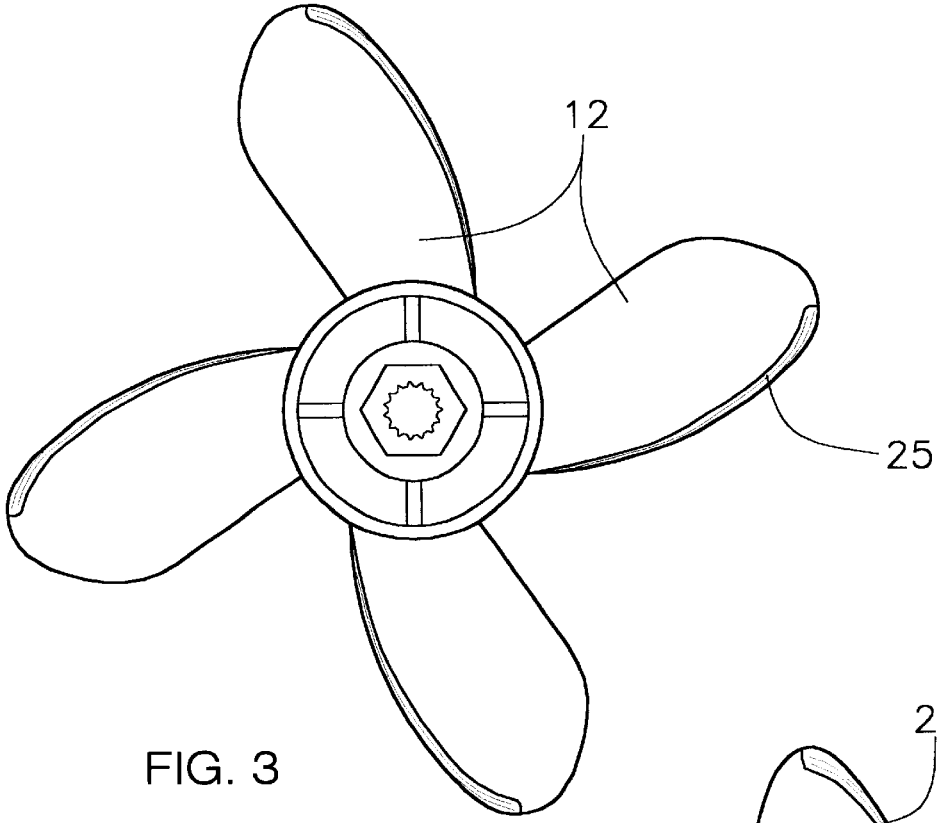
FIG. 3 is a rear elevational view of another embodiment of the present invention.

In one embodiment of the present invention, as particularly illustrated in FIGS. 3 and 4, the lip 25 mouthed on each of the spaced vanes 12 extends along an entire length of the leading edge 13 of each of the spaced vanes 12. The length of the lip 25 controls the amount of surface area permitted to engage the fluid.

As illustrated in FIG. 5, the lip 25 mounted on each of the spaced vanes 12 has an outer surface 26, an inner surface 27 and a lateral edge 29. In one embodiment of the present invention, the inner surface 27 engages the fluid and disperses a plurality of low-pressure gas bubbles positioned generally adjacent to the plurality of spaced vanes 12.

In one embodiment of the present invention, each of the spaced vanes 12 may comprise a substantially rigid material such as, for example, an aluminum, steel or plastic material. However, various materials may be employed in the manufacture of each of the spaced vanes 12.

In one embodiment of the present invention, the lip 25 mounted on each of the spaced vanes 12 may comprise a substantially rigid material such as, for example, an aluminum, steel or plastic material. However, various materials may be employed in the manufacture of the lip 25 mounted on each of the spaced vanes 12.

Each of the spaced vanes 12 is radially coupled to the hub 20. The hub 20 has a first end 31 and an open second end 32. The open second end 32 is designed for receiving and mating with a motor shaft of a motor. The hub 20 may be coupled to the motor shaft by conventional means. The hub 20 may employ at an internal hub connected to the hub by a plurality of spines being coupled to and extending therebetween. The internal hub may have an inner surface having a plurality of grooves extending therein for receiving at least one spline extending away from the motor shaft.

The hub 20 may also include an annular lip 40 that is coupled to and extends about the open second end 32 of the hub 20. The annular lip 40 aids in directing fluid toward the plurality of vanes 12.

The hub 20 may comprise a substantially rigid material such as, for example, an aluminum, steel, or plastic material. However, various materials may be employed in the manufacture of the hub 20.

In use, the propeller turns clockwise causing the lip 25 mounted on the leading edge 13 of each of the spaced vanes 12 to engage the fluid and disperses the low-pressure gas bubbles that form adjacent to plurality of spaced vanes 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the vane structure for a propeller. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A vane structure for a propeller having a hub mountable to a motor shaft of a motor, wherein said propeller prevents motor damage due to cavitation, said propeller comprising:

a plurality of spaced vanes being mounted to and extending away from the hub, each of said spaced vanes having a leading edge, a trailing edge and an end; and a lip being mounted on said end of each of said spaced vanes for engaging and holding a volume of fluid, thereby dispersing low-pressure gas bubbles positioned generally adjacent to said plurality of spaced vanes, wherein each of said lips extends along a portion of said leading edge of each of said spaced vanes.

2. A vane structure for a propeller having a hub mountable to a motor shaft of a motor, wherein said propeller prevents motor damage due to cavitation, said propeller comprising:

a plurality of spaced vanes being mounted to and extending away from the hub, each of said spaced vanes having a leading edge, a trailing edge and an end; and a lip being mounted on said end of each of said spaced vanes for engaging and holding a volume of fluid, thereby dispersing low-pressure gas bubbles positioned generally adjacent to said plurality of spaced vanes, wherein said lip extends along said leading edge of each of said spaced vanes and has a width that tapers from an end of each of said spaced vanes toward the hub.

3. A propeller mountable to a motor shaft of a motor for preventing motor damage due to cavitation, said marine propeller comprising:

a hub couplable to the motor shaft of the motor;

a plurality of spaced vanes being mounted to and extending away from said hub, each of said spaced vanes having a leading edge, a trailing edge and an end; and a lip being mounted on said end of each of said spaced vanes for engaging a fluid and dispersing low-pressure gas bubbles positioned generally adjacent to said plurality of spaced vanes, wherein said lip extends along a portion of said leading edge of each of said spaced vanes.

4. A propeller mountable to a motor shaft of a motor for preventing motor damage due to cavitation, said marine propeller comprising:

a hub couplable to the motor shaft of the motor;

a plurality of spaced vanes being mounted to and extending away from said hub, each of said spaced vanes having a leading edge, a trailing edge and an end; and a lip being mounted on said end of each of said spaced vanes for engaging a fluid and dispersing low-pressure gas bubbles positioned generally adjacent to said plurality of spaced vanes, wherein said lip extends along said leading edge of each of said spaced vanes and has a width that tapers from an end of each of said spaced vanes toward said hub.

* * * * *